US007498537B1

(12) United States Patent
Duwel

(10) Patent No.: US 7,498,537 B1
(45) Date of Patent: Mar. 3, 2009

(54) INTEGRATED CONDUCTIVE RADIO BUTTON

(75) Inventor: Jeffrey A. Duwel, Plymouth, MI (US)

(73) Assignee: Freudenberg-NOK General Partnership, Plymouth, MI (US)

( * ) Notice: Subject to any disclaimer, the term of this patent is extended or adjusted under 35 U.S.C. 154(b) by 0 days.

(21) Appl. No.: 11/844,436

(22) Filed: Aug. 24, 2007

(51) Int. Cl.
*H01H 13/704* (2006.01)

(52) U.S. Cl. ..... 200/517; 200/5 A

(58) Field of Classification Search ..... 200/511, 200/512, 517, 341, 329, 296, 344, 345; 341/22; 345/168, 169
See application file for complete search history.

(56) References Cited

U.S. PATENT DOCUMENTS

| | | | | | |
|---|---|---|---|---|---|
| 3,950,627 | A | | 4/1976 | Murata et al. | |
| 4,242,546 | A | | 12/1980 | Alonso | |
| 4,490,587 | A | * | 12/1984 | Miller et al. | 200/5 A |
| 4,609,791 | A | * | 9/1986 | Abbat | 200/5 A |
| 4,929,804 | A | | 5/1990 | Kawai et al. | |
| 5,308,943 | A | | 5/1994 | Screven et al. | |
| 5,403,984 | A | * | 4/1995 | Ogawa | 200/517 |
| 5,950,810 | A | * | 9/1999 | Pan et al. | 200/344 |
| 5,957,272 | A | * | 9/1999 | Kim | 200/512 |
| 6,326,571 | B1 | | 12/2001 | Kitamura et al. | |
| 6,355,890 | B1 | * | 3/2002 | Kuroda | 200/5 A |
| 6,580,043 | B1 | * | 6/2003 | Spratte | 200/517 |
| 6,750,415 | B2 | * | 6/2004 | Yamagami | 200/517 |
| 7,034,239 | B2 | * | 4/2006 | Miyako | 200/512 |
| 7,115,827 | B2 | * | 10/2006 | Tseng | 200/341 |
| 7,217,893 | B1 | | 5/2007 | Huang et al. | |
| 7,259,341 | B2 | * | 8/2007 | Quinque et al. | 200/511 |

* cited by examiner

*Primary Examiner*—Michael A Friedhofer
(74) *Attorney, Agent, or Firm*—Ronald W. Wangerow; Harness, Dickey & Pierce, P.L.C.

(57) ABSTRACT

An integrated conductive button, includes a housing and a printed circuit board mounted in proximity to the housing. The printed circuit board includes at least one electric contact portion disposed thereon and a button member is supported by the housing and includes at least one elongated post having a conductive elastomeric material disposed on a tip of the at least one elongated post. An elastomeric web skirt surrounds the at least one elongated post and is disposed against a seat surface of the housing. Upon pressing the button member, the elastomeric web skirt buckles to allow the conductive elastomeric material on the tip of the elongated post to contact the at least one electric contact on the printed circuit board.

14 Claims, 5 Drawing Sheets

INTEGRATED CONDUCTIVE RADIO BUTTON

FIELD

The present disclosure relates to an integrated conductive button switch for use with radios and in other push button switch applications.

BACKGROUND

The statements in this section merely provide background information related to the present disclosure and may not constitute prior art.

Push button switches are commonly used in many applications for making a contact in an open circuit on a printed circuit board. Such applications are employed on radio controls and vehicle climate controls in vehicle applications and can also be employed in home appliances and other types of equipment. In one design, as shown in FIGS. 10 and 11, a plastic push button 100 is mounted to a housing or bezel 102 and engages a knob 104 that is mounted to a printed circuit board 106. The knob 104 is typically formed as a part of a keypad base 114 that can be made from liquid silicone rubber or other elastomeric material. The keypad base 114 is secured to the printed circuit board 106 by a retaining plate 108. The knob includes a conductive rubber disc 110 mounted to its lower surface opposite to an open circuit 112 disposed on the surface of the printed circuit board 106. The knob 104 includes a generally conically shaped web portion 116 also made from an elastomeric material such as liquid silicone rubber. The knob 104 and web portion 116 can be integrally formed with the keypad base 114. As illustrated in FIG. 11, the knob 104 can be depressed via actuation of the button 100 to cause the web portion 116 to buckle and allow the conductive rubber disk 110 to contact the open circuit contacts 112 on the printed circuit board 106.

SUMMARY

An integrated conductive push button switch, includes a housing and a printed circuit board mounted in proximity to the housing. The printed circuit board includes at least one electric contact portion disposed thereon and a button member is supported by the housing and includes at least one elongated post having a conductive elastomeric material disposed on a tip of the at least one elongated post. An elastomeric web skirt surrounds the at least one elongated post and is disposed against a seat surface of the housing. Upon pressing the button member, the elastomeric web skirt buckles to allow the conductive elastomeric material on the tip of the elongated post to contact the at least one electric contact on the printed circuit board.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
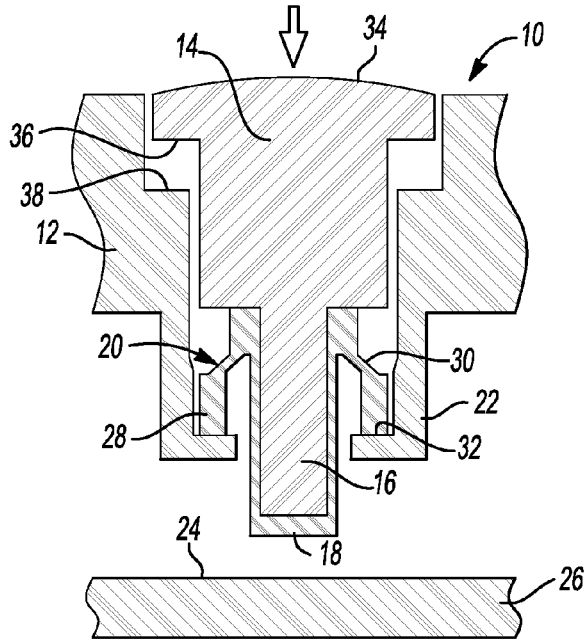
FIG. 1 is a cross-sectional view of a of a push button switch according to the principles of the present disclosure.

The following description is merely exemplary in nature and is not intended to limit the present disclosure, application, or uses. It should be understood that throughout the drawings, corresponding reference numerals indicate like or corresponding parts and features.

With reference to FIG. 1, a push-button switch 10, according to the principles of the present disclosure, will now be described. The push-button switch 10 includes a housing 12 which can be in the form of a bezel or front plate of an apparatus for receiving the push-button switch assembly 10. The housing 12 receives a button member 14 which can be plastic or can be made of other known materials. The button member 14 includes an elongated post 16 having a conductive elastomeric material 18 disposed on the tip thereof. An elastomeric web skirt 20 surrounds the at least one elongated post 16 and is disposed against a seat surface 22 of the housing 12. The conductive material 18 on the tip portion of the post 16 of the button member 14 opposes an electric contact 24 disposed on a surface of a printed circuit board 26.

The conductive elastomeric material 18 on the tip of the at least one post 16 and the elastomeric web skirt 20 can each be molded directly to the button member 14. Furthermore, the conductive elastomeric material 18 on the tip of the at least one post 16 and the elastomeric web skirt 20 can be formed from the same elastomeric material. The elastomeric material can include a conductive liquid silicone material or other polymer-based material (i.e. rubber or plastic) with some determined acceptable degree of compliance and conductivity.

The elastomeric web skirt 20 includes an annular distal end portion 28 that is received against the seat surface 22 of the housing and a generally conical portion 30 extending between the annular distal end portion 28 and the elongated post 16. The seat surface 22 of the housing is surrounded by an annular wall portion 32 that receives the annular distal end portion 28 of the elastomeric web skirt 20. The seat surface 22 and annular wall portion 32 define a generally cup-shaped seat 40 which projects from the remainder of the housing 12 in a direction of the printed circuit board 26.

The button member 14 includes an engagement surface 34 which is adapted to be engaged by a user's finger to apply a force for activating the button switch assembly 10. The engagement surface 34 is accessible from outside of the housing 12 such as being located on the face a vehicular radio or climate control system or on the face of any other appliance or equipment. The button member 14 includes a radially outwardly extending flange portion 36 that opposes a shoulder 38 of the housing 12 to limit the axial movement of the button member 14 relative to the housing 12.

Figure 2:
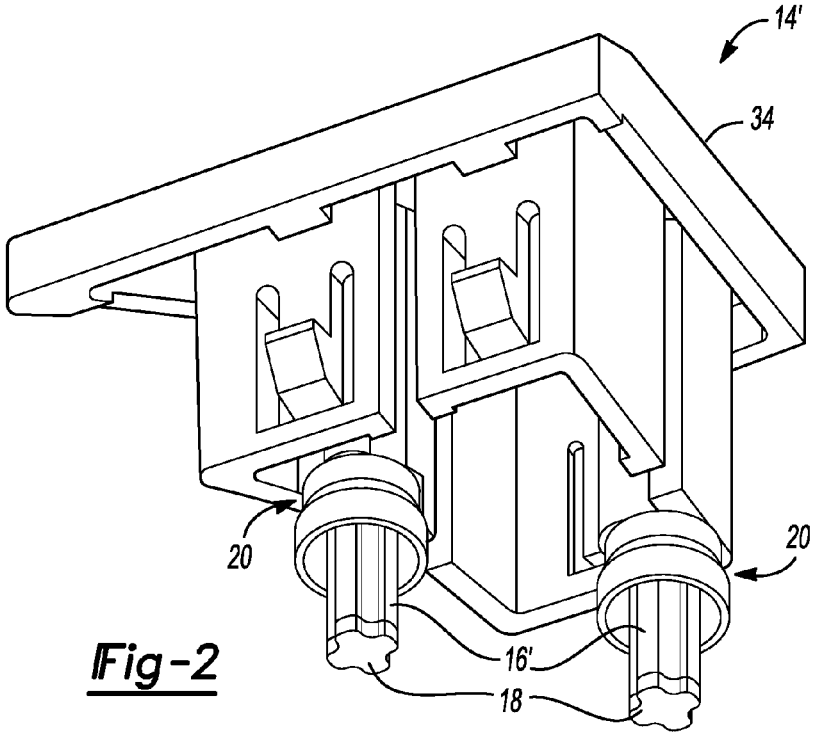
FIG. 2 is a bottom perspective view of a button member according to the principles of the present disclosure.
Figure 3:
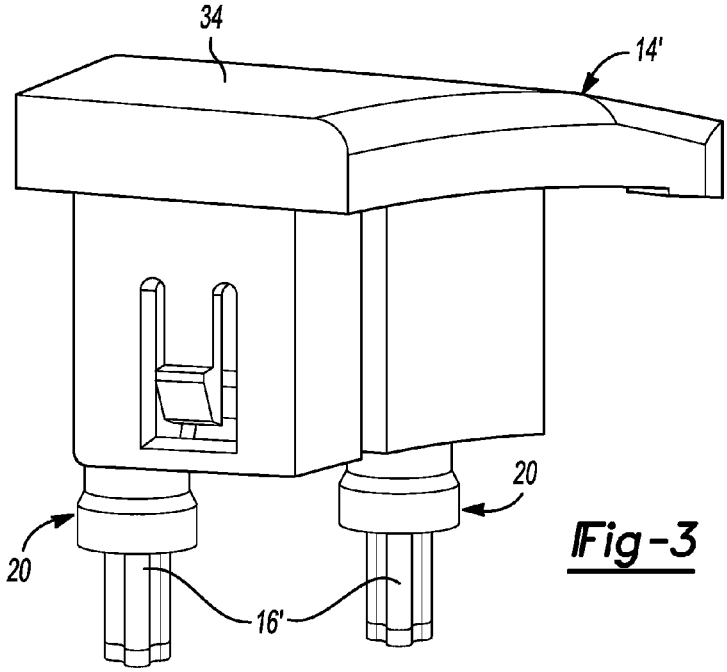
FIG. 3 is a side perspective view of the button member shown in FIG. 2.
Figure 4:
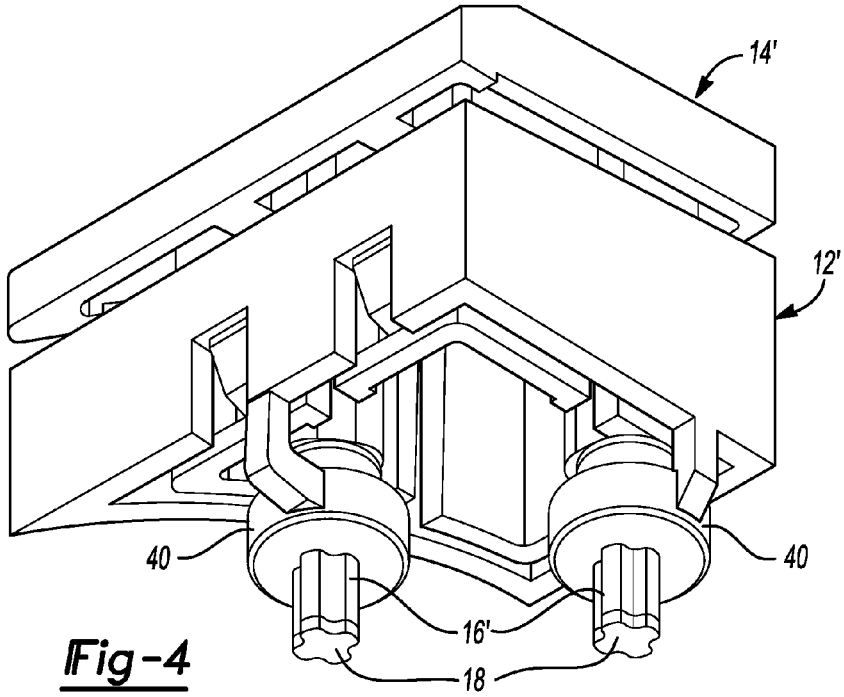
FIG. 4 is a bottom perspective view of a button member assembled to a housing according to the principles of the present disclosure.
Figure 5:
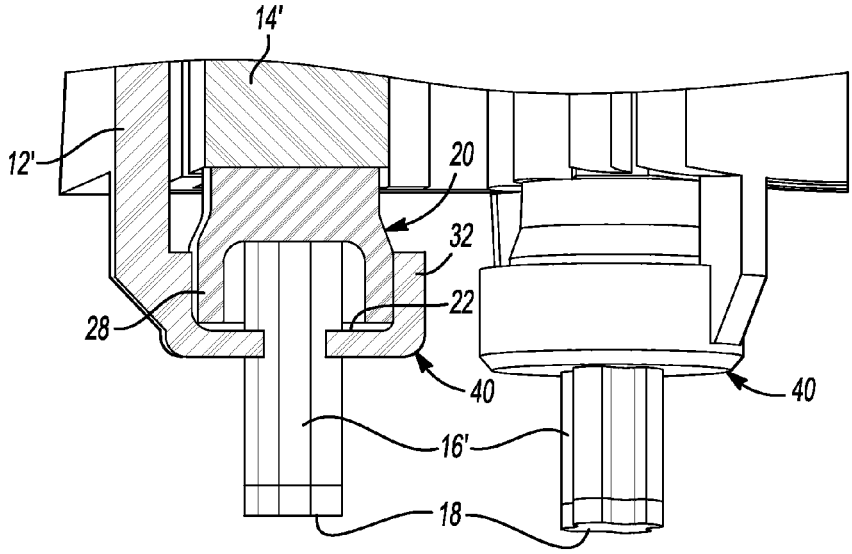
FIG. 5 is a cross sectional view illustrating the engagement of the button member with the housing according to the principles of the present disclosure.
Figure 6:
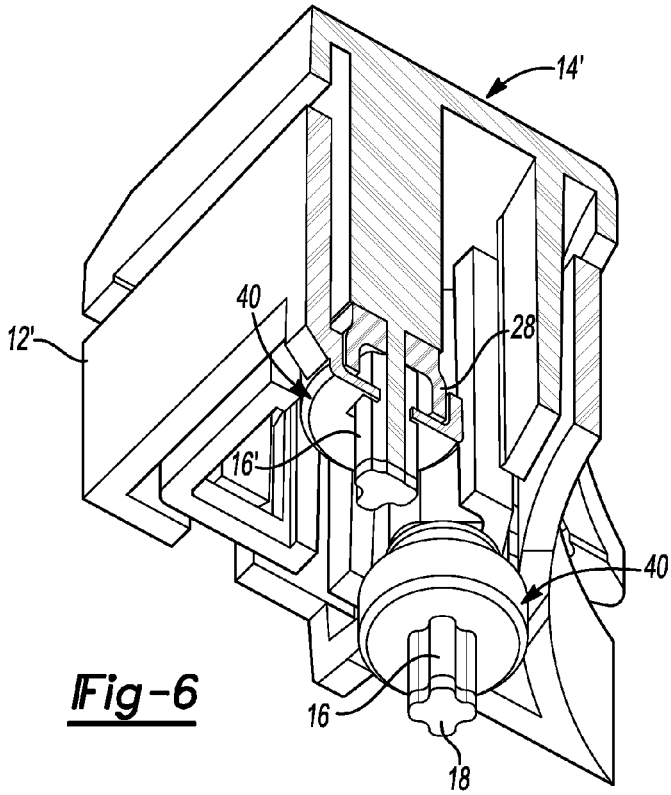
FIG. 6 is a partially cut-away perspective view illustrating the engagement of the button member with the housing according to the principles of the present disclosure.
Figure 9:
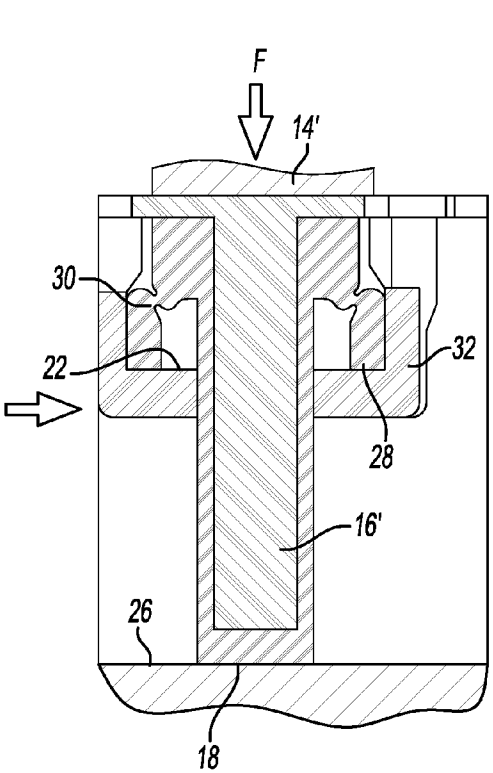
FIG. 9 is a cross-sectional view similar to FIG. 8 illustrating the button member in a fully activated position.
Figure 8:
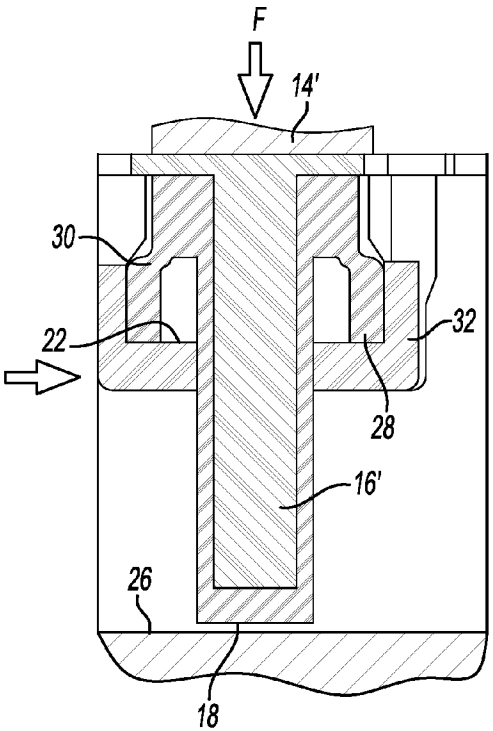
FIG. 8 is a cross-sectional view similar to FIG. 7 illustrating the button member in a partially activated position.
Figure 7:
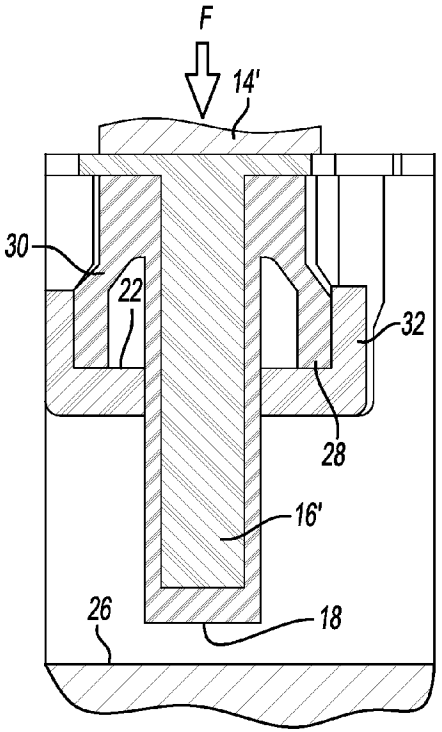
FIG. 7 is a cross-sectional view illustrating the button member in its non-activated position.
Figure 10:
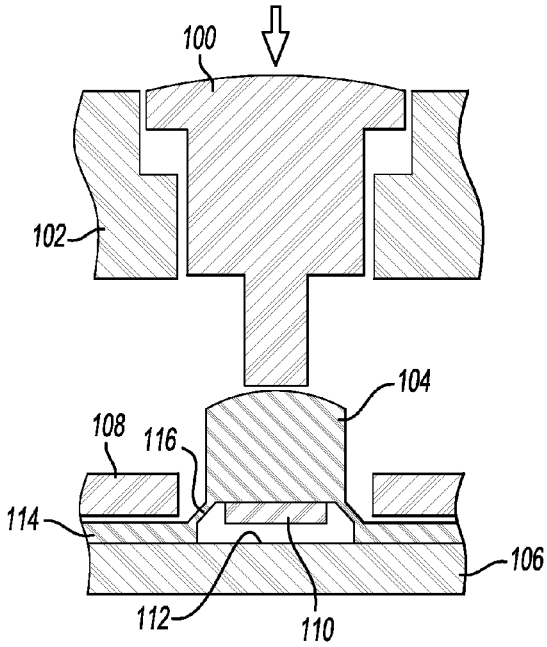
Fig-10 PRIOR ART
FIG. 10 is a cross-sectional view of a prior art push button switch.
Figure 11:
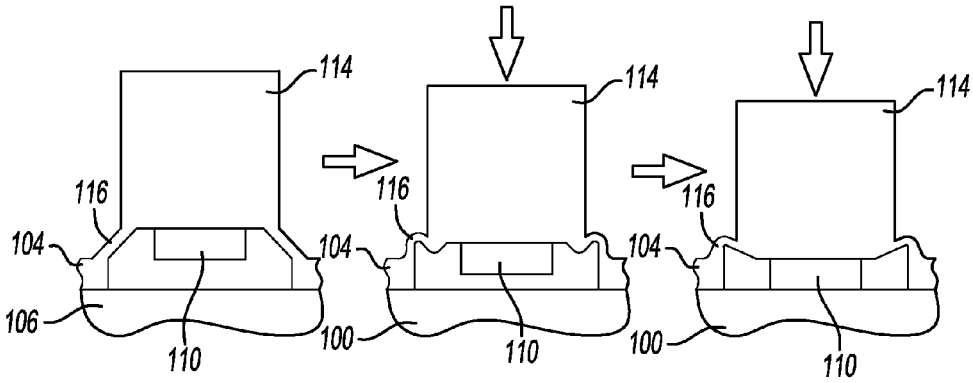
Fig-11 PRIOR ART
FIG. 11 is a schematic illustration of the activation of the prior art switch of FIG. 10.

As illustrated in FIGS. 2 and 3, the button member 14' can include multiple posts 16' which are each provided with integral conductive tips 18 for contacting an open circuit on a printed circuit board 26. As illustrated in FIGS. 4-6, the button member 14' can be received in a housing member 12' which is provided with a pair of cup-shaped seats 40 projecting from the housing 12'. The elastomeric web skirts 20 of each post 16' is received within the annular wall portion 32 with the distal end portion 28 of the elastomeric web skirts engaging the seat surface 22 therein. FIG. 7 illustrates the push-button assembly 10 in a non-activated position wherein the conductive material 18 on the tip of the post 16' is spaced away from the printed circuit board 26 so that no electrical contact is made. In FIG. 8, a force "F" is beginning to be applied to the surface 34 of the button member 14' causing the web portion 30 of the elastomeric web skirt 20 to buckle allowing the post 16' to travel toward the printed circuit board 26. In FIG. 9, the button member 14' is pressed to its fully activated position with the web portion 30 of the elastomeric web skirt 20 being fully buckled to allow the conductive material 18 at the end of post 16' to contact the open circuit on the surface of the printed circuit board 26, thus creating a closed circuit for providing an electrical signal, as desired.

For purposes of this disclosure, the web portion 30 of the elastomeric web skirt 20 has been shown as a generally conical section, although it should be understood that the web portion 30 can include other forms including a stepped bellows-type configuration that allows the web skirt to return to its un-deformed state after the force "F" is removed from the surface 34 of the button member 14. The design of the present disclosure, as compared to the prior art design of FIG. 1, eliminates the need for the keypad and retainer which provides for lower cost, fewer pieces for assembly, and reduced weight.

The reaction force, Force-Displacement Curve, of the present design is a factor considered by the end customer. The present design as it is shown is meant to simulate the current Force-Displacement curve of a typical prior art design. The web/button/rubber design could be modified to result in other Force-Displacement curves which may be more beneficial to a particular customer's application. For instance, the web thickness, length, diameter could be changed. Also, the button itself could be modified to provide some level of compliance (for instance, the button could act as a spring element).

What is claimed is:

1. An integrated conductive button, comprising:

a housing including an aperture defining a seat surface;

a printed circuit board mounted in proximity to said housing, said printed circuit board including at least one electric contact portion disposed thereon; and a button member located within said aperture and supported by said housing and including at least one elongated post having a conductive elastomeric material disposed on a tip of said at least one elongated post and an elastomeric web skirt surrounding said at least one elongated post and disposed against said seat surface within said aperture, wherein upon pressing said button member, said elastomeric web skirt buckles to allow said conductive elastomeric material on said tip of said elongated post to contact said at least one electric contact on said printed circuit board.

2. The integrated conductive button according to claim 1, wherein said conductive elastomeric material on said tip of said at least one post and said elastomeric web skirt are each molded directly to said button member.

3. The integrated conductive button according to claim 1, wherein said conductive elastomeric material on said tip of said at least one post and said elastomeric web skirt are formed from the same elastomeric material.

4. The integrated conductive button according to claim 3, wherein said elastomeric material is a conductive silicone material.

5. The integrated conductive button according to claim 1, wherein said button member is formed from a plastic material.

6. The integrated conductive button according to claim 1, wherein said elastomeric web skirt includes an annular distal end portion received against said seat surface of said housing and a generally conical portion extending between said annular distal end portion and said at least one elongated post.

7. The integrated conductive button according to claim 6, wherein said seat surface of said housing is surrounded by an annular wall portion that receives said annular distal end portion of said elastomeric web skirt.

8. The integrated conductive button according to claim 7, wherein said seat surface and said annular wall portion define a generally cup shaped seat projecting from said housing.

9. The integrated conductive button according to claim 1, wherein said button member includes an engagement surface adapted to be engaged by a user's finger.

10. The integrated conductive button according to claim 9, wherein said engagement surface of said button member is accessible from outside of said housing.

11. The integrated conductive button according to claim 9, wherein said button member includes a flange portion opposing a shoulder of said housing.

12. The integrated conductive button according to claim 11, wherein said seat surface faces a direction generally opposite said printed circuit board.

13. The integrated conductive button according to claim 11, wherein said aperture includes first and second axial ends generally opposite one another, said seat surface being located between said first and second axial ends of said aperture.

14. The integrated conductive button according to claim 11, wherein said elastomeric web skirt is located radially between a wall defining said aperture and said button member.

* * * * *